United States Patent [19]

Egan

[11] 4,279,408

[45] Jul. 21, 1981

[54] APPARATUS FOR CHANGING TUYERES ON A BLAST FURNACE

[75] Inventor: James L. Egan, Sault Ste. Marie, Canada

[73] Assignee: The Algoma Steel Corporation, Limited, Ontario, Canada

[21] Appl. No.: 16,303

[22] Filed: Feb. 28, 1979

[30] Foreign Application Priority Data

Dec. 7, 1978 [CA] Canada ..... 317548

[51] Int. Cl.[3] ..... F27B 1/10

[52] U.S. Cl. ..... 266/271; 266/273; 266/218

[58] Field of Search ..... 29/822-824, 29/239, 252, 244; 266/271, 272, 270, 45, 273, 218; 254/84

[56] References Cited

U.S. PATENT DOCUMENTS

| | | | |
|---|---|---|---|
| 1,361,103 | 12/1920 | Scott | 266/271 |
| 1,866,080 | 7/1932 | Brosius | 266/47 |
| 2,065,399 | 12/1936 | Ryan et al. | 29/402.08 |
| 2,566,637 | 9/1951 | Roberts | 29/244 |
| 3,211,442 | 10/1965 | Helmer | 266/34 |
| 3,458,918 | 8/1969 | Kitajima et al. | 29/252 |
| 3,459,418 | 8/1969 | Ueshima et al. | 266/41 |
| 3,516,651 | 6/1970 | Honda et al. | 266/271 |
| 3,567,044 | 3/1971 | Travis | 29/823 |
| 3,667,748 | 6/1972 | Dienenthal | 266/271 |
| 3,889,344 | 6/1975 | Bode, Jr. et al. | 29/252 |
| 4,087,084 | 5/1978 | Meyers | 266/287 |

FOREIGN PATENT DOCUMENTS

| | | |
|---|---|---|
| 428866 | 5/1926 | Fed. Rep. of Germany . |
| 506822 | 9/1930 | Fed. Rep. of Germany . |
| 1216899 | 5/1966 | Fed. Rep. of Germany . |
| 1942943 | 7/1966 | Fed. Rep. of Germany . |
| 1958821 | 4/1967 | Fed. Rep. of Germany . |
| 1909326 | 9/1970 | Fed. Rep. of Germany . |
| 2314120 | 1/1977 | France . |

*Primary Examiner*—Daniel C. Crane
*Attorney, Agent, or Firm*—Cushman, Darby & Cushman

[57] ABSTRACT

Apparatus for changing tuyere and tuyere stock assemblies of a blast furnace in accordance with one aspect of the invention includes support rail means extending around the furnace and fixed a selected distance above the level of the tuyeres of the furnace. A primary carriage is arranged for travel along said rail means and first motor means are provided for effecting such travel. A guide frame is connected to the primary carriage and depends downwardly therefrom. The guide frame is connected for rotation about a vertical axis relative to the primary carriage. A second motor means is provided for effecting this relative rotation about the vertical axis. A carriage support frame is associated with the guide frame and is adapted to travel upwardly and downwardly along the latter in a vertical path. Third motor means are connected between the carriage support frame and the main support carriage to effect the upward and downward movement of the carriage support frame. The carriage support frame includes an elongated horizontal section defining a path of travel for a tuyere stock support carriage. A tuyere stock support carriage is disposed on the carriage support frame for travel along the horizontal section thereof at a level corresponding generally to the level of the tuyeres. Fourth motor means are provided for effecting movement of the tuyere stock support carriage along the horizontal section of the support frame. The tuyere stock support carriage has clamp means thereon for engaging and holding a tuyere stock.

By selective actuation of the above-noted first, second, third and fourth motor means, the tuyere stock support carriage may be brought into close juxtaposition and alignment with a tuyere stock and the clamp means engaged therewith and the tuyere assembly either retracted from or inserted into the blast furnace in a prescribed manner.

9 Claims, 9 Drawing Figures

APPARATUS FOR CHANGING TUYERES ON A BLAST FURNACE

BACKGROUND OF THE INVENTION

This invention relates to an apparatus for changing tuyeres on a blast furnace. More particularly it relates to apparatus for handling the tuyeres and their associated tuyere stock assemblies during installation in and removal from a blast furnace.

As is well known in the art, a blast furnace is one of the largest single installations in any fully integrated steel mill which is designed to produce pig iron essential for the manufacture of steel. In the production of iron, a predetermined quantity of iron ore, iron pellets, sinter, coke and limestone is charged into the furnace and is ignited. Effective and controlled combustion is sustained by blowing preheated air at temperatures some 2000°-2300° F. through the furnace. The hot air is blown into a circular refractory lined pipe known as the bustle pipe and from there enters a series of blow-pipes and water cooled copper nozzles distributed uniformly around the circumference of the furnace. These copper nozzles are known as tuyeres. The tuyeres are in direct contact with the molten iron and are subject to extreme heat, abrasion etc., and thus must be replaced from time to time. It is necessary to remove the lower tuyere stock and blow-pipe assembly to change the tuyere. A modern large size blast furnace may have as many as forty blow-pipe assemblies and tuyeres and the weight of an individual tuyere stock and blow-pipe may reach 3000 lbs.

The problem of changing blow-pipes and tuyeres is compounded by the sizes and weights of the components involved as well as by the intense heat, the proximity of cooling pipes, furnace supporting columns and structures and the furnace tapping arrangements.

On smaller furnaces of an older design having some 12 to 16 tuyeres, the tuyere changes are normally performed by the furnace crew with the aid of relatively simple lifting devices. On newer relativey large furnaces, much more complex rigging is involved and a crew of highly trained specialists is required to accomplish the tuyere replacements. A fork-lift truck is also needed to handle the tuyere stock and blow-pipe assembly to remove a tuyere. The whole operation is considered time consuming, dangerous and difficult. Several types of apparatus have been devised in the part in an attempt to facilitate the tuyere changing operation. However, to the best of applicants' knowledge, these techniques and equipment were never used with any degree of success and generally did not find acceptance by the steel making industry.

SUMMARY OF THE INVENTION

Apparatus for changing tuyere and tuyere stock assemblies of a blast furnace in accordance with one aspect of the invention includes support rail means extending around the furnace and fixed a selected distance above the level of the tuyeres of the furnace. A primary carriage is arranged for travel along said rail means and first motor means are provided for effecting such travel. A guide frame is connected to the primary carriage and depends downwardly therefrom. The guide frame is connected for rotation about a vertical axis relative to the primary carriage. A second motor means is provided for effecting this relative rotation about the vertical axis. A carriage support frame is associated with the guide frame and is adapted to travel upwardly and downwardly along the latter in a vertical path. Third motor means are connected between the carriage support frame and the primary carriage to effect the upward and downward movement of the carriage support frame. The carriage support frame includes an elongated horizontal section defining a path of travel for a support carriage. A support carriage is disposed on the carriage support frame for travel along the horizontal section thereof at a level corresponding generally to the level of the tuyeres. Fourth motor means are provided for effecting movement of the support carriage along the horizontal section of the support frame. The support carriage has a clamp or holding means thereon for engaging and holding a tuyere stock and/or related assembly.

By selective actuation of the above-noted first, second, third and fourth motor means, the support carriage may be brought into close juxtaposition and alignment with a tuyere stock and/or related assembly and the clamp or holding means engaged therewith and the tuyere assembly either retracted from or inserted into the blast furnace in a prescribed manner.

In a preferred embodiment of the invention the support rail means are disposed below and are suspended from the bustle pipe which surrounds the furnace.

In a further feature of the invention brake means capable of coacting between the rail means and the primary carriage are provided for holding the support carriage at a desired location along the rail means such as during the course of insertion into or retraction of the tuyere assembly relative to the furnace.

In a preferred form of the invention the support carriage is rollingly supported for movement along the horizontal section of the carriage support frame. The fourth motor means preferably comprises an elongated fluid actuated cylinder and ram assembly interconnected between the last mentioned frame and the support carriage for effecting insertion or retraction of the tuyere assembly relative to the furnace. It will be appreciated that due to the relatively large weights involved, such cylinder and ram assembly must be capable of developing relatively large forces.

In a preferred embodiment of the invention, the above-noted guide frame includes a ring gear thereon with the second motor means comprising a rotary fluid driven motor operatively engaged with the ring gear for rotating the guide frame and its associated carriage and carriage support frame about the vertical axis. This rotation permits the carriage and the horizontal section of the carriage support frame to be generally aligned with the path of movement of the primary carriage along the rail means or alternatively to allow it to be swung at a generally right angle thereto as when a tuyere assembly is being inserted into or retracted from the blast furnace.

The above-noted third motor means preferably comprises a fluid actuated cylinder and ram assembly for effecting said up and down movement of the support carriage and its support frame to assist in vertically aligning the clamp means with a selected portion of the tuyere stock. As a further feature, adjustment means are interposed between the clamp means and the support carriage for effecting fine vertical adjustment of the clamp means to further assist in effecting the desired vertical alignment.

The above described apparatus also preferably includes means for temporarily connecting or supporting the carriage support frame from a part of the blast furnace during withdrawal and/or insertion of a tuyere assembly so that forces arising from such action are in a substantial measure taken up by such part of the blast furnace.

The use of apparatus in accordance with the invention enables the elimination of the numerous hazards involved when handling heavy and extremely hot parts of tuyere stock and blow-pipe assemblies by hand-operated lifting devices. Such apparatus also permits a considerable reduction in the time exposure to extreme heat experienced by members of the tuyere changing crew.

It has been found that members of the furnace crew can be easily trained to use apparatus in accordance with the invention in an efficient and safe manner. With the use of apparatus according to the invention it is no longer necessary to bring in highly trained rigging specialists to do the job.

A very substantial saving in time required to change an individual tuyere can be achieved. It is estimated that the time required per tuyere can be reduced on an average by about one hour. In a furnace requiring thirty-one tuyere changes over a six month period, this represents thirty-one hours of additional production rated at approximately 200 tons of pig iron per hour or approximately 12,400 tons of additional pig iron production per year. In addition, the use of one embodiment according to the invention provided a savings of about six man hours of tuyere changing labour per tuyere thus representing, in the case given above, an annual savings of approximately 370 man hours of skilled labour. In addition, a fork lift vehicle is no longer required for this operation.

BRIEF DESCRIPTION OF THE DRAWINGS

In drawings which illustrate a preferred embodiment of the invention.

DETAILED DESCRIPTION OF THE PREFERRED EMBODIMENT

Figure 1:
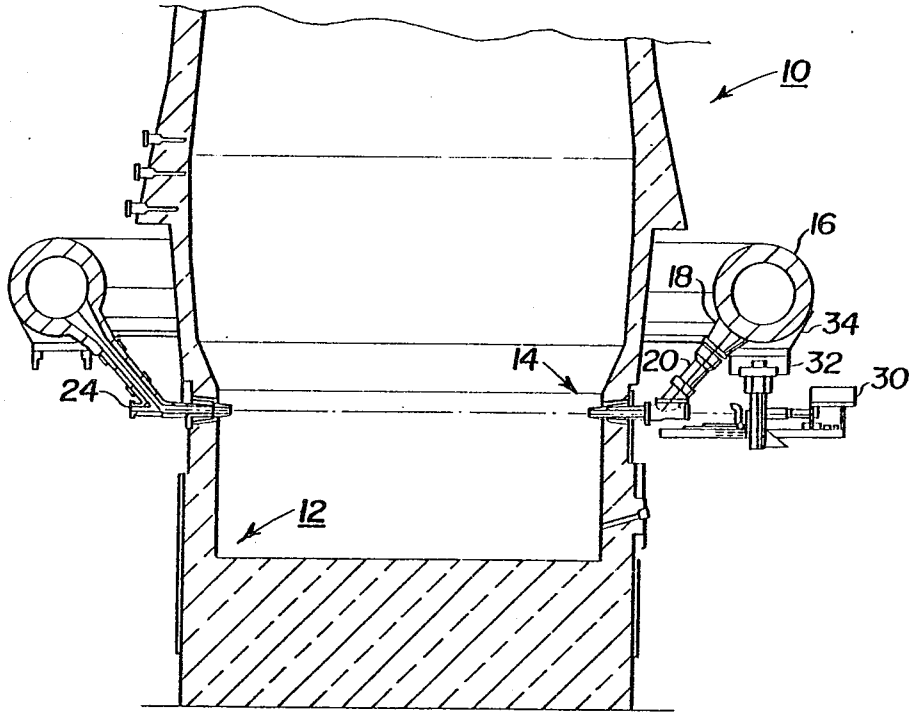
FIG. 1 is a cross-section view of a lower portion of a blast furnace illustrating the location of the bustle pipe, the tuyere assemblies, and a tuyere changing apparatus in accordance with the invention.

With reference now to FIG. 1 there is shown in cross section the lower portion of a blast furnace 10, such furnace including a hearth 12 of any suitable conventional construction and having a plurality of tuyeres 14 spaced equally around the hearth a short distance below the top of the latter. A large circular refractory-lined and insulated pipe 16, known as the bustle pipe, encircles the furnace at about the mantle level and distributes the heated blast from the hot blast main to each tuyere connection. The bustle pipe is interconnected to the tuyeres via a neck portion 18, and a goose neck 20, the lower end of the latter being bolted about a flanged connection 22 to a portion of the tuyere stock 24.

Tuyere changing apparatus in accordance with the invention is designated broadly by reference number 30 in FIG. 1 and is supported or suspended below a pair of rails 32 which, in turn, are suspended below the bustle pipe via suitable brackets 34. The rails 32 can thus be made to substantially completely encircle the furnace hearth thereby allowing the tuyere changing apparatus 30 access to all of the tuyere assemblies 14.

Figure 2:
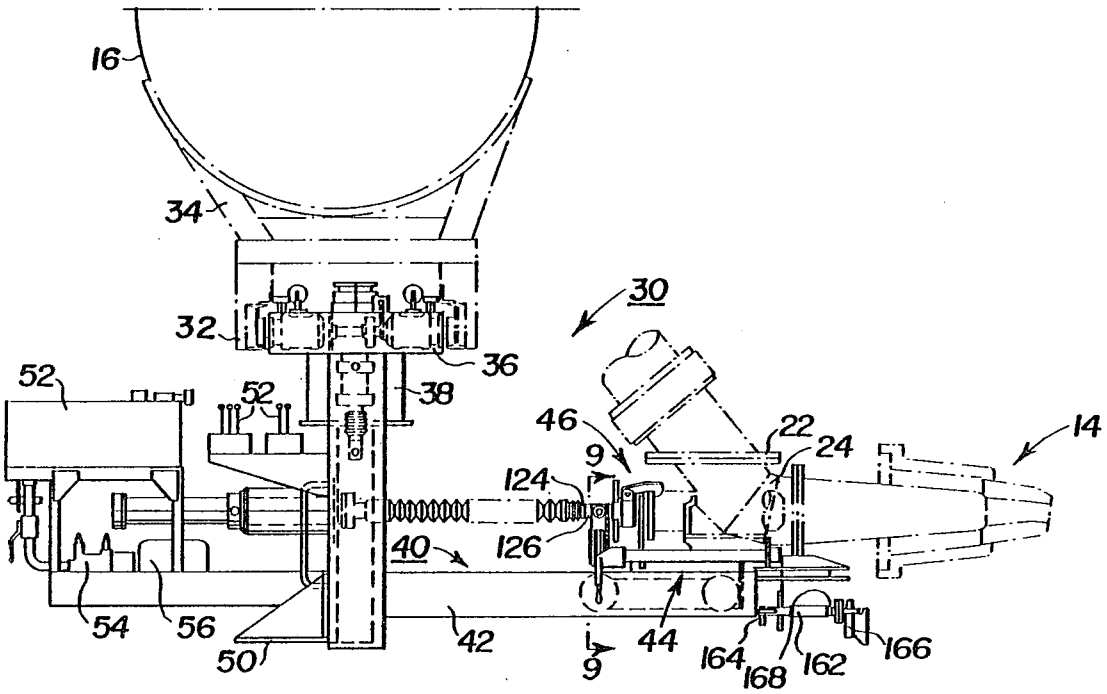
FIG. 2 is a side elevation view of tuyere changing apparatus in accordance with the invention, associated assemblies of the blast furnace being shown in phantom.
Figure 3:
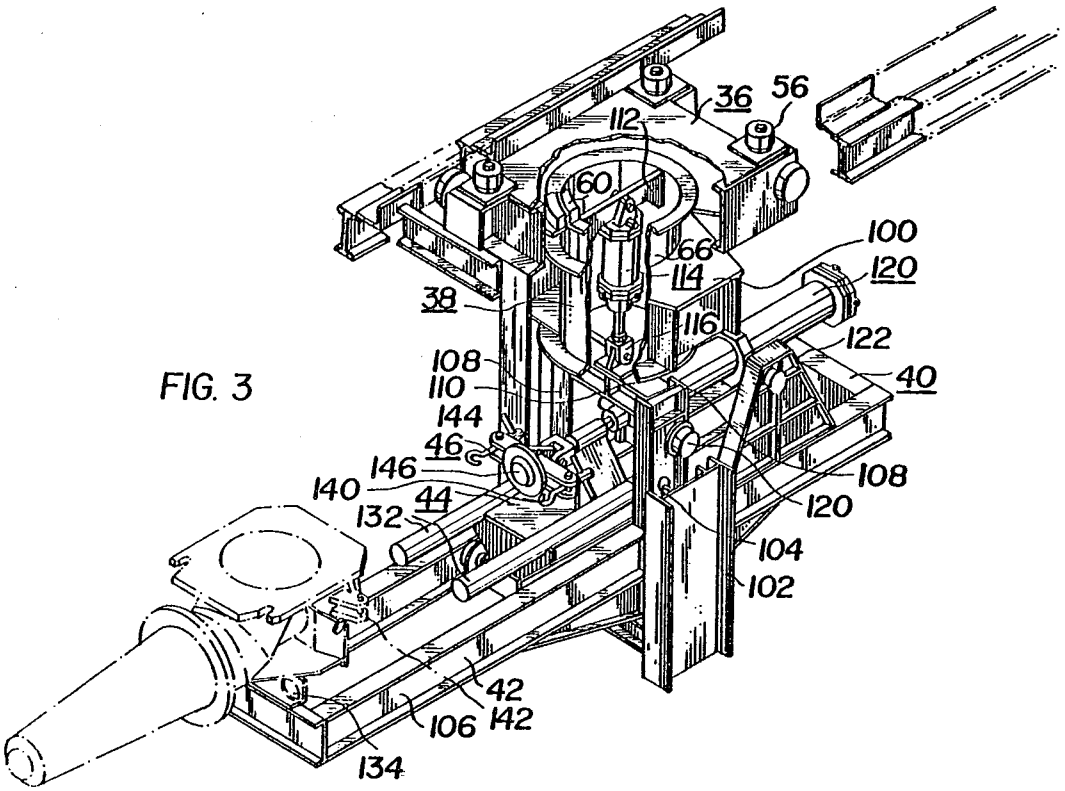
FIG. 3 is a perspective view of a tuyere changing apparatus in accordance with the invention, certain portions of the apparatus being cut away for purposes of clarity.

The major components of the tuyere changing apparatus are illustrated in FIGS. 2 and 3. There is firstly provided a primary carriage 36 which is arranged to travel along the spaced apart rails 32. A guide frame assembly 38 is connected to the primary carriage 36 and depends downwardly therefrom. This guide frame 38 is connected for rotation about a vertical axis relative to the primary carriage 36 by means to be described more fully hereinafter. A carriage support frame 40 is operatively associated with the guide frame 38 and is capable of travelling upwardly and downwardly along the latter along a vertical path. This carriage support frame includes an elongated horizontal section 42 defining a straight line path of travel for a tuyere stock support carriage 44. This support carriage is disposed on the horizontal section of the carriage support frame for travel therealong at a level corresponding generally to the level of the tuyere assemblies 14 of the furnace. The tuyere stock support carriage is provided with a clamping assembly 46 for engaging and holding a tuyere stock 24 in secure engagement therewith.

The tuyere changing apparatus, as best seen in FIG. 2, further includes an operator's support platform 50 on which the operator may stand in order to control the various hydraulic control levers 52. The rear end of the carriage support frame also has mounted thereon a reservoir 52 for hydraulic oil as well as a hydraulic pump 54, a main drive motor 56 connected to such pump as well as various hydraulic valving and control assemblies (not shown) and which are all of a generally conventional nature.

Figure 4:
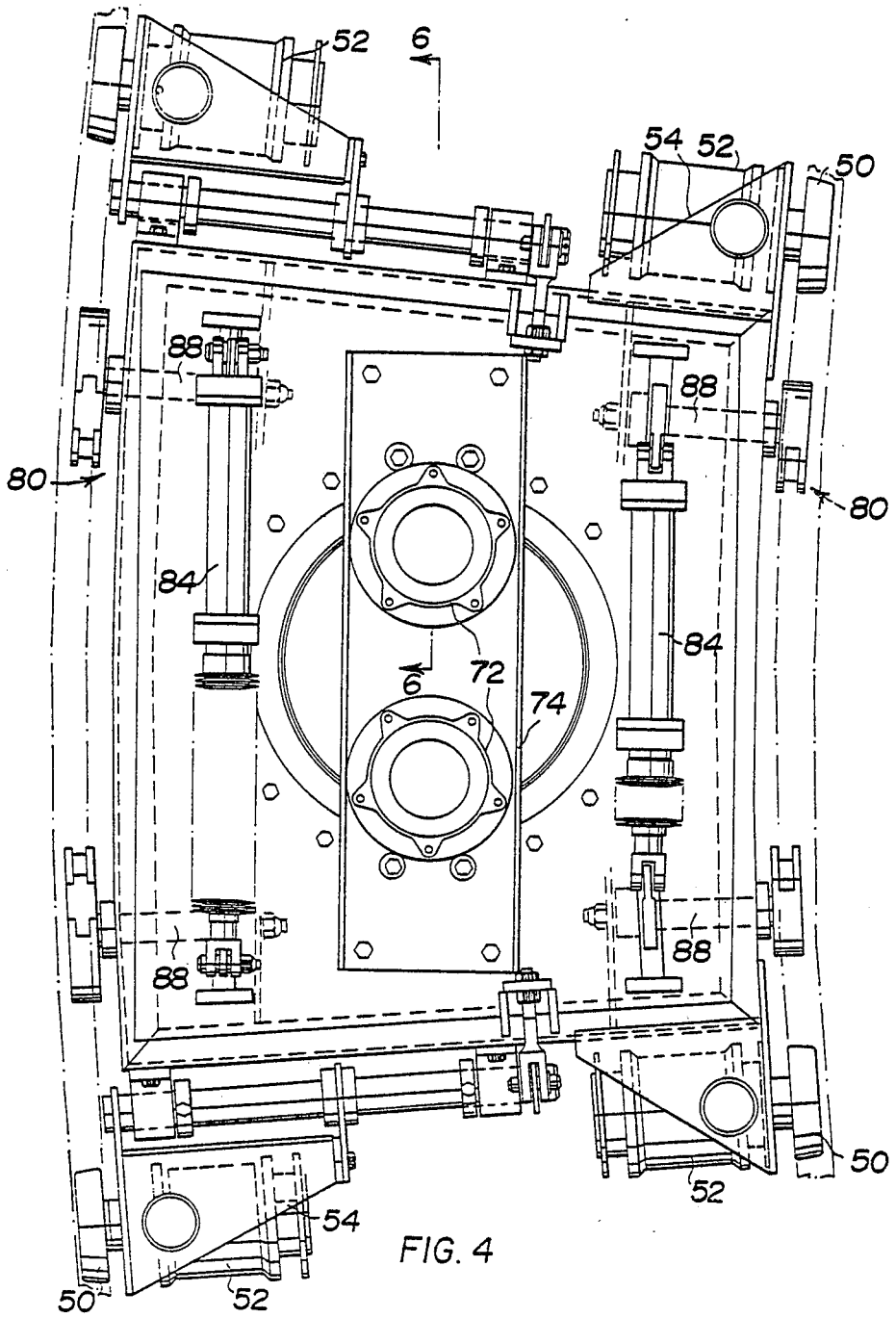
FIG. 4 is a plan view of a portion of the tuyere changing apparatus illustrating portions of the primary carriage and its associated assemblies.
Figure 5:
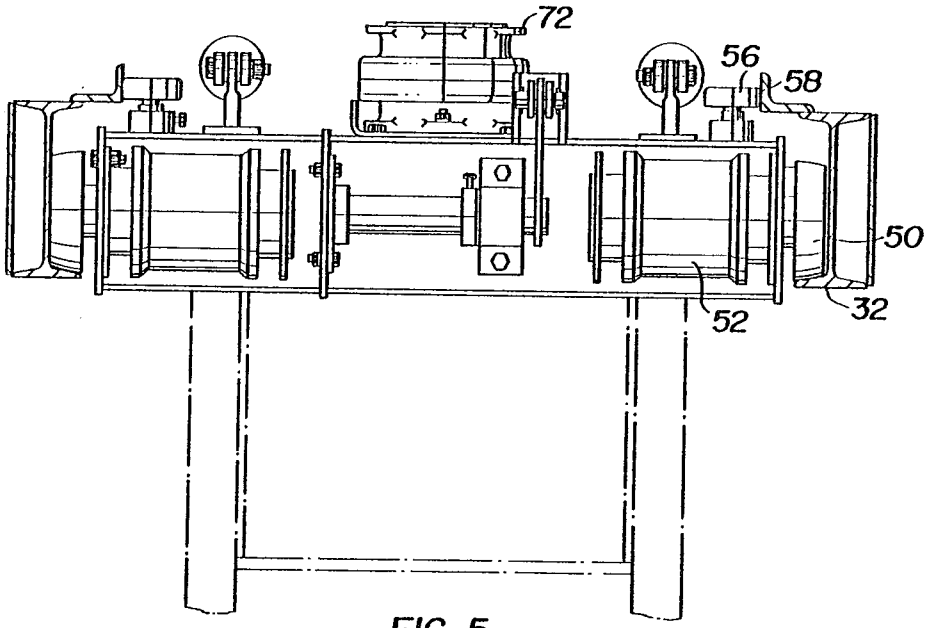
FIG. 5 is a view of primary carriage looking in the direction of arrow 5 as shown in FIG. 4.

With further reference to the drawings it will be seen that the primary carriage 36 is of a relatively massive box-like construction and includes a plurality of drive wheels 50, each of which is connected to a respective one of the four corners of the support carriage as best seen in FIG. 4. Each drive wheel 50 is directly connected to a respective one of a plurality of hydraulic drive motors 52, each of the latter being mounted to the support carriage proper by means of sturdy corner bracket arrangements 54. The drive wheels 50 are somewhat tapered and are sized so as to roll smoothly along the inwardly directed flanges of the support rails 32. Also disposed adjacent the four corners of the primary carriage proper are horizontal thrust transfer wheels 56 which serve to rollingly engage inwardly directed rail portions 58 priovided on the support rails 32 thereby to eliminate any undesired yawing of the main support carriage 36 during operation.

Figure 6:
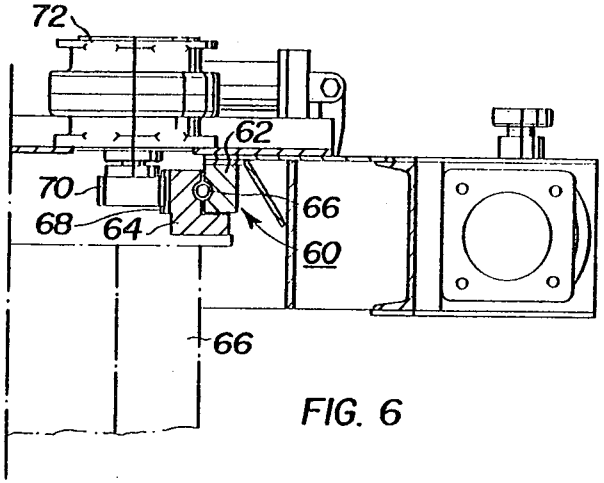
FIG. 6 is a section view taken along line 6—6 of FIG. 4.

The above noted guide frame 38 is connected to the main support carriage 36 by way of a thrust and support bearing assembly 60 as best seen in FIGS. 3 and 6. The thrust and support bearing assembly 60 includes an outer bearing ring 62 which is firmly bolted to the upper main plate of the main support carriage and an inner bearing ring 64 which is firmly bolted to a generally cylindrical upper portion 66 of the guide frame 38. Interposed between the outer and inner bearing rings 62 and 64 are a plurality of ball bearings 66 designed to accommodate the very substantial forces involved. The inner surface of the inner bearing ring 64 is provided with gear teeth 68 extending completely therearound thus in effect providing a ring gear which engages at two diametrically opposed locations with the respective drive gears 70 of a pair of high torque hydraulic motors 72. These hydraulic motors 72 are mounted in a spaced apart location on the upper surface of the primary carriage 36 by way of a suitable support bracket 74. Thus, when the hydraulic motors 72 are actuated, the inner bearing ring 64 is rotated relative to the outer bearing ring 62 thus effecting rotation of guide frame 38 about a vertical axis as defined by the center of rotation provided by the thrust and support bearing 60.

Figure 8:
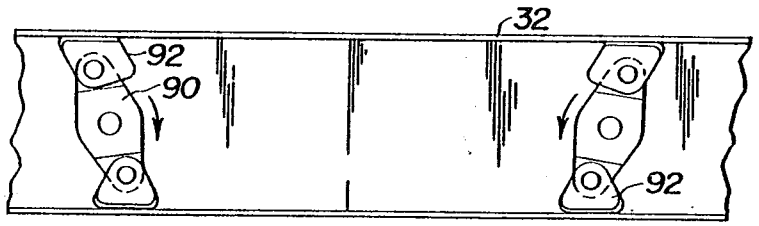
FIG. 8 is a partial view similar to that of FIG. 7 showing the brake means in the "on" condition.
Figure 7:
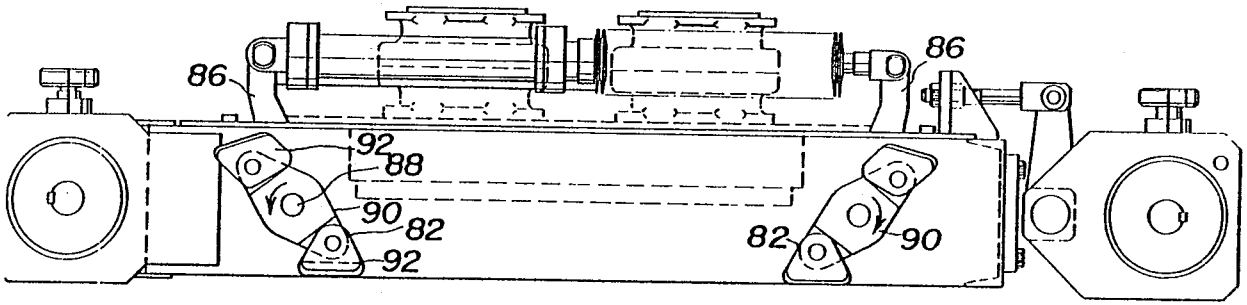
FIG. 7 is a side elevation view of the primary carriage showing a portion of the brake means which cooperates with the support rail means.

With continued reference to the primary carriage 36, brake means capable of coacting between the rails 32 and the primary carriage for holding the latter at a desired location along the rails will now be described. The brake assemblies, broadly designated by reference numeral 80, comprise spaced apart pairs of brake shoe assemblies 82 mounted to each of the opposing sides of the primary carriage. Each pair of brake shoe assemblies 82 is actuated by an associated hydraulic cylinder and ram assembly 84 as best seen in FIG. 4 such assembly being pivotally connected at each of its opposing ends via relatively short lever arms 86 to associated generally horizontally extending pivot shafts 88. Each pivot shaft 88 extends outwardly of its associated side of the primary carriage and is connected to a brake shoe support arm 90. Each support arm 90 has a brake shoe 92 pivotally connected to each of its opposing ends. These brake shoes 92 are each adapted to come into braking frictional contact with a respective one of the upper and lower inwardly directed flanges of the guide rails 32. When the respective hydraulic cylinder and ram assemblies 84 are extended the brake arms 90 are rotated in the direction shown by the arrows in FIG. 7 thus releasing the brake shoes 92 from contact with the flanges of the support rails 32. However, upon retraction of the respective hydraulic cylinder and ram assemblies 84, the brake support arms 90 are rotated in the opposite directions as illustrated by the arrows in FIG. 8 thus bringing the brake shoes 92 into firm frictional engagement with the flanges of the support rails. When this action occurs, the primary carriage and the various assemblies associated therewith are firmly secured at a desired location along the rail means thus preventing unwanted movement of the apparatus as, for example, during the course of insertion into or retraction of a tuyere assembly relative to the furnace.

Returning now to the guide frame 38, it will be seen that the same includes a pair of oppositely directed shoulder portions 100 fabricated from heavy steel plates and welded to the above-noted cylindrical section 66. Welded to each shoulder portion 100 is a respective downwardly depending I-beam section 102, to the inner face of each of which is welded an inwardly directed guide and support channel 104. These inwardly facing guide and support channels 104 serve to define a vertical path of travel for the carriage support frame 40 as will be described more fully hereinafter.

The carriage support frame 40 includes a pair of elongated horizontally disposed I-beams 106 which, in part serve to define the above referred to elongated horizontal section 42 which defines a path of travel for the tuyere stock support carriage 44. These elongated I-beams 106 are connected together in spaced apart parallel relationship by suitable cross members. Each of the elongated I-beams 106 includes an upwardly extending strut 108 securely welded thereto, with the upper ends of the two struts 108 being interconnected by means of a transverse frame member 110. A heavy support plate 112, as best seen in FIG. 3, extends diametrically across the upper end portion of the previously noted cylindrical section 66 of the guide frame 38. To the mid-point of this support plate 112 there is pivotally attached the upper end of a hydraulic cylinder and ram assembly 114. The opposite end of this ram assembly 114 is pivotally connected at 116 to the previously noted transverse frame member 110. It will thus be seen that when hydraulic cylinder and ram assembly 114 is retracted or extended, the entire carriage support frame 40 is raised and lowered relative to the guide frame 38 and the primary carriage 36. In order to stabilize and guide the carriage support frame 40, the above-noted struts 108 are each provided with a plurality of outwardly projecting guide rollers 120 which cooperate closely in rolling relationship with the above-noted guide and support channels 104.

In order to propel the tuyere stock support carriage 44 back and forth along the path of travel defined by the I-beams 106, there is provided an elongaged hydraulic cylinder and ram actuator arrangement 120, the latter being pivotally mounted for limited movement in a vertical plane on opposed trunnions 122 connected adjacent rearwardly disposed portions of the carriage support frame 40. The ram 124 of hydraulic actuator 120 is connected via a transverse pin arrangement 126 to the rear end of the tuyere stock support carriage 44. The tuyere stock support carriage 44 is of a sturdy welded construction and includes a base frame 126 (see FIG. 9) having a spaced apart pair of axles 128 journaled therein by suitable bearing means, such axles carrying on their outer ends respective flanged wheels 130 which cooperate closely with the inwardly directed upper and lower flanges of the parallel I-beams 106 of the carriage support frame 40. With reference to FIGS. 2 and 3 it will be seen that the tuyere stock support carriage 44 includes a spaced apart pair of horizontally disposed cylindrical members 132 which are adapted to enter into correspondingly spaced apart apertures 134 provided in the tuyere stock. Thus, when the tuyere stock 134 has been disconnected from the furnace, these horizontally disposed members 132 assist in supporting same on the carriage 44.

The above-referred to clamp assembly 46 for engaging and holding the tuyere stock to the support carriage 44 may assume a variety of configurations depending upon the exact configuration of the tuyere stock in question. FIGS. 2 and 3 show somewhat modified versions of the clamp assembly. In FIG. 3, the clamp assembly 46 includes opposed hook-like members 140 adapted to engage with spaced apart ear and vertical pin assemblies 142 located on the tuyere stock. Threaded hand-operated assemblies 144 are associated with each of the hook assemblies 140 thus permitting the hook assemblies 140 to be tightened thus drawing the tuyere stock into firm engagement with the tuyere stock support carriage and particularly into engagement with a guide and support plate 146 which is disposed intermediate the hook-like assemblies 140 and in direct alignment with the ram 124 of hydaulic cylinder assembly 120.

Figure 9:
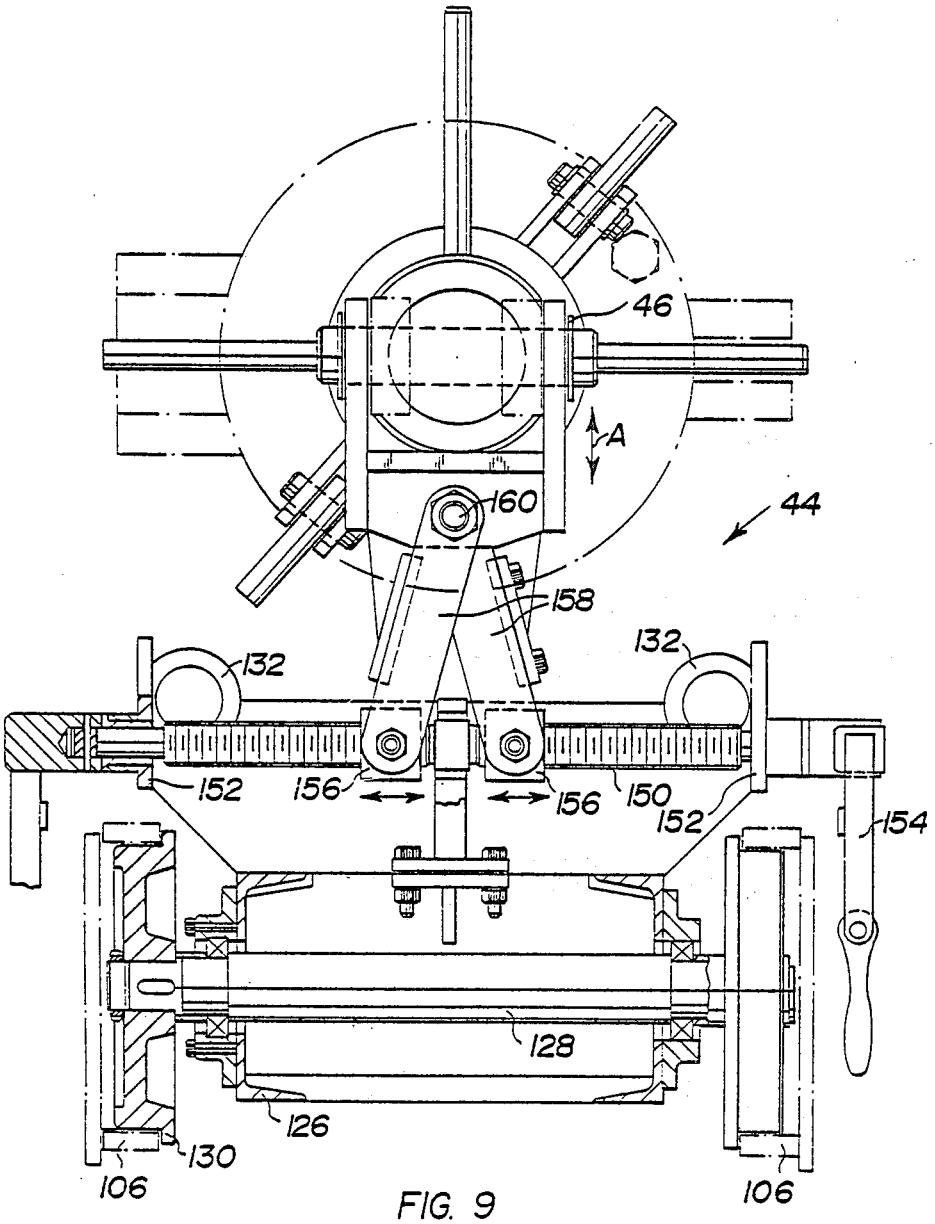
FIG. 9 is a section view taken along line 9—9 of FIG. 2 and showing the fine adjustment means associated with the tuyere stock support carriage.

By virtue of the vertical movement afforded by the hydraulic cylinder and ram assembly 114, the tuyere stock support carriage 44 may be readily brought into approximate vertical alignment with the tuyere stock just prior to its removal from the furnace. However, in order to provide for fine adjustments in this vertical positioning, the tuyere stock support carriage 44 is provided with means for effecting fine vertical adjustment of the clamp assembly 46 to further assist in effecting the desired vertical alignment. These means are best seen in FIG. 9. As best seen in FIG. 9, there is shown a transversely disposed threaded rod 150 which is journaled adjacent its opposing ends in suitable support bracket 152 attached to an upper portion of the support carriage 44 proper. This threaded screw 150 may be manually rotated by a hand crank assembly 154. A pair of internally threaded blocks 156 are disposed on threaded rod 150 the threaded blocks 156 being pivotally connected to respective scissor-like arms 158, the upper ends of which arms are pivoted at 160 to the clamp assembly 46. Thus, as hand crank 154 is rotated, the blocks 156 are caused to travel in opposite horizontal directions as determined by the direction of rotation with the clamp assembly 46 being either raised or lowered in the directions given by arrows A as best seen in FIG. 9.

Since substantial thrust forces are involved during the retraction or insertion of a tuyere assembly, it is highly desirable to include means for temporarily connecting or supporting the carriage support frame 40 relative to the blast furnace. Such means are broadly designated by reference number 162 in FIG. 2. The support means 162 includes an elongated member connected to a suitable bracket 164 mounted to the frontal end of the carriage support frame 40. The opposite end of support means 162 is adapted to fit over a vertically disposed sturdy pin member 166 welded to a suitable portion of the furnace. A threaded portion 168 may be provided thereby to enable the support member 162 to be made longer or shorter depending upon requirements. When properly adjusted, forces arising by virtue of the retraction or insertion of the tuyere assemblies are in substantial measure taken up by the pin 166 attached to the blast furnace thus eliminating the imposition of unnecessary stresses and strains on the tuyere changing apparatus as a whole.

As noted previously, the tuyere changing apparatus is relatively simple to operate. The operator, standing on his support platform 50, moves the appropriate hydraulic control lever thus actuating hydraulic motors 54 thereby causing the primary carriage 36 and the various assemblies suspended therefrom to travel along the support rails 32 to the desired location. Following this, the hydraulic cylinder and ram assemblies 84 are actuated thereby causing the brake shoes 92 to be brought into firm braking engagement with the flanges of support rails 32. Following this action, the operator then actuates hydraulic motors 72 thus effecting rotation of their associated drive gears 70 and effecting rotation of the entire guide frame 38, carriage support frame 40 and tuyere stock support carriage 44 about a vertical axis thereby to bring the carriage support frame into general alignment with the tuyere assembly which is to be replaced. The hydraulic cylinder and ram assembly 144 is then actuated as desired thereby to raise or lower the entire carriage support frame 40 to bring it to the desired elevation following which hydraulic cylinder and ram assembly 120 is actuated thereby causing the tuyere stock support carriage 44 to be advanced forwardly to cause the horizontally disposed members 132 to enter into the apertures 134 in the tuyere stock and to bring the plate member 146 into secure engagement with the rear face of the tuyere stock. Following this, the hook assemblies 140 are engaged with the pin and ear assemblies 142 of the tuyere stock and the threaded hand tightening assemblies 144 are actuated thereby to securely clamp the tuyere stock to the clamping assembly 46. As noted previously, if any fine adjustments are to be made in the elevation of the clamping assembly 46, the hand crank 154 may be rotated as described previously in conjunction with FIG. 9. Then, after the tuyere stock has been unbolted from its associated structures, the hydraulic cylinder and ram assembly 120 is actuated thereby to forcibly withdraw the tuyere assembly from the furnace. After the tuyere assembly is clear of the furnace, the above-noted hydraulic motors 72 are actuated thereby to cause the tuyere stock support frame 40 etc., to again rotate about the above-noted vertical axis in such a way as to clear any obstructions that may be present following which the operator will release the brakes and then actuate the several hydraulic motors 52 thus causing the entire apparatus to travel along the support rails. When the apparatus reaches a further desired location, the hydraulic cylinder and ram 120 may be extended and the defective tuyere assembly transferred to other equipment (not shown). A new tuyere assembly may be installed by reversing generally the sequence of events described above.

What is claimed is:

1. Apparatus for changing tuyere and tuyere stock assemblies of a blast furnace, said apparatus comprising:

(a) support rail means extending adjacent to the furnace and fixed a selected distance above the level of the tuyeres of the furnace;

(b) a primary carriage arranged for travel along said rail means, and first motor means for effecting such travel;

(c) a guide frame connected to said primary carriage and depending downwardly therefrom, said guide frame being connected for rotation about a vertical axis relative to such primary carriage; and second motor means for effecting such relative rotation about said vertical axis;

(d) a carriage support frame associated with said guide frame and constrained for travel upwardly and downwardly along the latter along a vertical substantially linear path, and third motor means connected between said carriage support frame and the primary carriage to effect said upward and downward movement of the carriage support frame, said carriage support frame having an elongated generally horizontal section defining a path of travel for a support carriage;

(e) a support carriage disposed on the carriage support frame for travel along said generally horizontal section thereof at a level determined by the vertical position of said carriage support frame relative to said guide frame, and fourth motor means for effecting movement of the support carriage along said generally horizontal section, the support carriage having holding means thereon for engaging and holding a tuyere stock or related assembly, (f) whereby, by selective actuation of said first, second, third and fourth motor means said support carriage may be brought into close juxtaposition and alignment with a tuyere stock or related assembly and the holding means engaged therewith and the tuyere stock or related assembly either retracted from or inserted into the blast furnace.

2. Apparatus according to claim 1 including brake means capable of co-acting between said rail means and the primary carriage for holding the latter at a desired location along the rail means such as during the course of insertion into or retraction of the tuyere assembly relative to the furnace.

3. Apparatus according to claim 1 wherein said support carriage is rollingly supported for movement along said generally horizontal section of the carriage support frame, and said fourth motor means comprising an elongated fluid actuated cylinder and ram assembly interconnected between said last mentioned frame and the support carriage for either inserting a tuyere assembly into the furnace or retracting the same therefrom.

4. Apparatus according to claim 2 wherein said support carriage is rollingly supported for movement along said generally horizontal section of the carriage support frame, and said fourth motor means comprising an elongated fluid actuated cylinder and ram assembly interconnected between said last mentioned frame and the support carriage for either inserting a tuyere assembly into the furnace or retracting the same therefrom.

5. Apparatus according to claim 1 wherein said guide frame includes a ring gear thereon and wherein the second motor means is a rotary fluid driven motor operatively engaged with said ring gear for rotating the guide frame and its associated carriage and carriage support frame about the vertical axis thereby to permit said carriage and the generally horizontal section of the carriage support frame to be generally aligned with the path of movement of the primary carriage along said rail means or to be disposed at generally a right angle thereto as when a tuyere assembly is being inserted into or retracted from the blast furnace.

6. Apparatus according to claim 4 wherein said guide frame includes a ring gear thereon and wherein the second motor means is a rotary fluid driven motor operatively engaged with said ring gear for rotating the guide frame and its associated carriage and carriage support frame about the vertical axis thereby to permit said carriage and the generally horizontal section of the carriage support frame to be generally aligned with the path of movement of the primary carriage along said rail means or to be disposed at generally a right angle thereto as when a tuyere assembly is being inserted into or retracted from the blast furnace.

7. Apparatus according to claim 1, 2 or 3 wherein the third motor means is a fluid actuated cylinder and ram assembly for effecting said up and down movement of the support carriage and its support frame to assist in vertically aligning said holding means with a selected portion of the tuyere assembly, and means interposed between said holding means and the support carriage for effecting fine vertical adjustment of said holding means to further assist in effecting the vertical alignment.

8. Apparatus according to claim 6 wherein the third motor means is a fluid actuated cylinder and ram assembly for effecting said up and down movement of the support carriage and its support frame to assist in vertically aligning said holding means with a selected portion of the tuyere assembly, and means interposed between said holding means and the support carriage for effecting fine vertical adjustment of said holding means to further assist in effecting the vertical alignment.

9. Apparatus according to any one of the claims 1–6 including means for temporarily supporting the carriage support frame from a part of the blast furnace during withdrawal and insertion of a tuyere assembly whereby forces arising from such action are in substantial measure taken up by such part of the blast furnace.

* * * * *